United States Patent [19]

Bearden et al.

[11] Patent Number: 4,745,970

[45] Date of Patent: May 24, 1988

[54] ROTATING HEAD

[75] Inventors: Robert M. Bearden, Fort Smith; W. A. Haynes, Greenwood, both of Ark.

[73] Assignee: Arkoma Machine Shop, Fort Smith, Ark.

[21] Appl. No.: 840,600

[22] Filed: Mar. 17, 1986

Related U.S. Application Data

[63] Continuation of Ser. No. 468,931, Feb. 23, 1983, abandoned.

[51] Int. Cl.[4] ..... E21B 33/03

[52] U.S. Cl. ..... 166/84

[58] Field of Search ..... 166/82–85; 175/195; 277/31; 285/368, 412; 384/906, 586, 571

[56] References Cited

U.S. PATENT DOCUMENTS

| | | | |
|---|---|---|---|
| 830,100 | 9/1906 | Post | 384/586 |
| 2,398,459 | 4/1946 | Province | 384/571 |
| 3,052,300 | 9/1962 | Hampton | 166/84 |
| 4,293,047 | 10/1981 | Young | 175/195 |
| 4,340,262 | 7/1982 | Rugh et al. | 384/906 X |
| 4,363,357 | 12/1982 | Hunter | 166/84 |
| 4,526,243 | 7/1985 | Young | 175/195 |
| 4,531,591 | 7/1985 | Johnston | 166/84 X |
| 4,560,001 | 12/1985 | Gonzales | 166/84 |

*Primary Examiner*—James A. Leppink
*Assistant Examiner*—David J. Bagnell
*Attorney, Agent, or Firm*—Dunlap, Codding & Peterson

[57] ABSTRACT

An improved rotating head having an inner barrel disposed within and rotatingly supported on an outer barrel wherein a rotary drive member is connected to the inner barrel. A kelly is extendable through the inner barrel and the rotary drive member is adapted to grippingly and sealingly engage the kelly so that rotation of the kelly causes rotation of the rotary drive member and the inner barrel connected thereto, the engagement between the rotary drive member and the kelly providing the sole source for rotating the rotary drive member and the inner barrel connected thereto. The rotary head also includes a bearing adjustment assembly which facilitates the rotatability of the inner barrel.

18 Claims, 1 Drawing Sheet

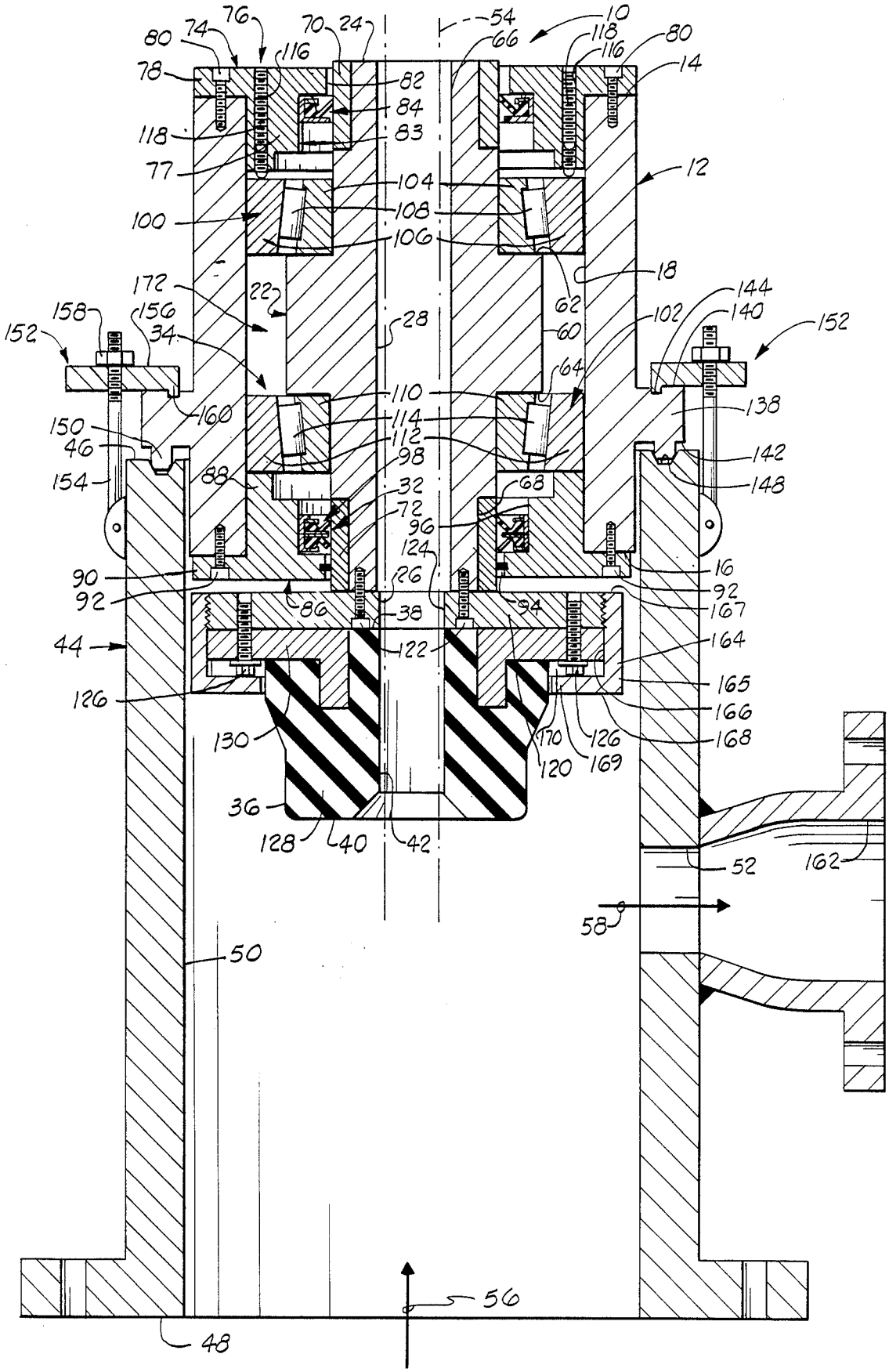
10
12
14
16
18
22
24
26
28
32
34
36
38
40
42
44
46
48
50
52
54
56
58
60
62
64
66
68
70
72
74
76
77
78
80
82
83
84
86
88
90
92
94
96
98
100
102
104
106
108
110
112
114
116
118
120
122
124
126
128
130
138
140
142
144
148
150
152
154
156
158
160
162
164
165
166
167
168
169
170
172

ROTATING HEAD

This application is a continuation of application Ser. No. 468,931 filed Feb. 23, 1983 now abd. and entitled ROTATING HEAD.

BACKGROUND OF THE INVENTION

The present invention relates generally to rotating heads and, more particularly, to a rotating head having a rotary drive member grippingly engageable with a kelly so rotation of the kelly causes rotation of the rotary drive member and an inner barrel connected thereto thereby providing a rotating head requiring no external source to cause rotation of the inner barrel and the rotating drive member connected thereto.

BRIEF DESCRIPTION OF THE DRAWINGS

The single FIGURE in the drawings shows a rotating head which is constructed in accordance with the present invention.

DESCRIPTION OF THE PREFERRED EMBODIMENT

Shown in the drawings is a rotating head 10 which is constructed in accordance with the present invention. In general, the rotating head 10 includes: a cylindrically shaped outer barrel 12 having an upper end 14, a lower end 16 and an outer barrel bore 18 extending axially therethrough intersecting the upper and the lower ends 14 and 16 and forming an inner peripheral surface; an inner barrel 22 having an upper end 24, a lower end 26, an inner barrel bore 28 extending axially therethrough intersecting the upper and the lower end 24 and 26 and forming an inner peripheral surface; a seal assembly 32 for providing a substantially fluid tight seal between the inner barrel 22 and the outer barrel 12; a rotating support assembly 34 for rotatingly supporting the inner barrel 22 on the outer barrel 12; a rotary drive member 36 having an upper end 38, a lower end 40 and a drive bore 42 extending therethrough intersecting the upper and the lower ends 38 and 40, the rotary drive member 36 being mounted on the lower end 26 portion of the inner barrel 22; and a bowl 44 having an upper end 46, a lower end 48 and a bowl opening 50 extending therethrough intersecting the upper end 46 and the lower end 48, the upper end 46 portion of the bowl 44 being connected to the lower end 16 portion of the outer barrel 12 and a discharge opening 52 being formed through a portion of the bowl 44 generally between the upper end 46 and the lower end 48 which extends generally perpendicularly with respect to the axially axis of the bowl opening 50.

During drilling operations at an oil well, gas well or oil and gas well drilling site (referred to herein simply as a well drilling site), a kelly (shown in dashed-lines and designated by the reference numeral 54) is extended into the well borehole (not shown in the drawing) and drilling fluid is passed into the borehole. A plurality of blowout preventers (not shown in the drawing) are connected to the well borehole and the rotating head 10 generally is connected to the uppermost blowout preventer, the kelly 54 extending through the rotating head 10 and the blowout preventers and into the well borehole. During the drilling operations, the drilling fluid is passed from the well borehole, up through the blowout preventers and up through the bowl 44 portion of the rotating head 10 in a direction 56, the rotating head 10 being designed to divert the received drilling fluid out through the discharge opening 52 in a direction 58, generally perpendicular to the direction 56, for passing the drilling fluid back to a fluid pit or pits located at the well drilling site generally near the drilling operations. The drilling fluid commonly is referred to in the industry as drilling mud.

The kelly 54 is rotating during the drilling operations and the kelly 54 generally has a non-circular shaped cross section. The rotating head 10 sealingly engages the rotating kelly 54 to prevent the drilling fluid from being passed upwardly through the rotating head 10 and onto the drilling platform floor or onto another portion of the drilling rig, the rotating head 10 functioning to divert the received drilling fluid for passing the drilling fluid back to the mud pit or pits.

The inner barrel 22 generally is cylinderically shaped and has a support flange 60 formed on the outer peripheral surface of the inner barrel 22. The support flange 60 is disposed generally midway between the upper end 24 and the lower end 26 of the inner barrel 22 and the support flange 60 extends circumferentially about the outer peripheral surface of the inner barrel 22. The support flange 60 extends a distance radially from the outer peripheral surface of inner barrel 22 thereby providing an upwardly facing support surface 62 which extends circumferentially about the outer peripheral surface of the inner barrel 22 and which is spaced a distance axially from the upper end 24 of the inner barrel 22, and a downwardly facing support surface 64 which extends circumferentially about the outer peripheral surface of the inner barrel 22 and which is spaced a distance axially from the lower end 26 of the inner barrel 22, the support surface 62 also being spaced a distance axially from the support surface 64.

A recess 66 is formed in the upper end 24 portion of the inner barrel 22 and a recess 68 is formed in the lower end 26 portion of the inner barrel 22. An upper sleeve 70 is disposed and secured in the recess 66 and a lower sleeve 72 is disposed and secured in the recess 68, the sleeves 70 and 72 preferably being constructed of chrome steel.

The inner barrel 22 is disposed in the outer barrel 18 and positioned such that the upper end 24 of the inner barrel 22 generally is coplanar with the upper end 14 of the outer barrel 12, the upper end 24 being in a plane slightly above the planar disposition of the upper end 14, as shown in the drawing, and such that the lower end 26 of the inner barrel 22 generally is coplanar with the lower end 16 of the outer barrel 12, the lower end 26 being in a plane slightly below the planar disposition of the lower end 16, as shown in the drawing.

The diameter of the inner barrel 22 formed by the outer peripheral surface of the support flange 60 is less than the inner diameter formed by the outer barrel bore 18, thereby providing a space between the outer peripheral surface of the inner barrel 22 and the support flange 60 and the inner peripheral surface of the outer barrel 12 formed by the outer barrel bore 18.

An upper cap 74 is connected to the upper end 14 of the outer barrel 12 and the upper cap 74 includes a portion of a bearing adjustment assembly 76. The upper cap 74 includes a base 77 and a flange 78 which extends a distance radially from the base 77, the flange 78 being disposed generally near the upper end of the base 77 of the upper cap 74.

In an assembled position, a portion of the base 77 extends into the outer barrel bore 18 and into the space between the inner peripheral surface formed by the outer barrel bore 18 and the outer peripheral surface of the inner barrel 22. In this position, the flange 78 engages the upper end 14 of the outer barrel 12 and a plurality of circumferentially spaced bolts 80 extend through the flange 78 and into the outer barrel 12 thereby securing the upper cap 74 to the outer barrel 12 (only two of the bolts 78 being shown in the drawing.

An opening 82 extends through a central portion of the upper cap 74, the upper end 24 portion of the inner barrel 22 being disposed within the opening 82 in the upper cap 74. A recess 83 is formed in the base 77 portion of the upper cap 74.

A portion of an upper seal assembly 84 is disposed in the recess 83 and the upper seal assembly 84 is adapted to sealingly engage the upper cap 74 and the outer peripheral surface of the inner barrel 22 or, more particularly, the upper sleeve 70, thereby cooperating to provide a fluid seal between the outer and the inner barrels 12 and 22. The upper seal assembly 84 forms a portion of the seal assembly 32.

A lower cap 86 is connected to the lower end 16 of the outer barrel 12. The lower cap 86 includes a base 88 and a flange 90 which extends a distance radially from the base 88, the flange 90 being disposed generally near the lower end of the base 88 of the lower cap 86.

In an assembled position, a portion of the base 88 extends into the outer barrel bore 18 and into the space between the inner peripheral surface formed by the outer barrel bore 18 and the outer peripheral surface of the inner barrel 22. In this position, the flange 90 engages the lower end 16 of the outer barrel 12 and a plurality of circumferentially spaced bolts 92 extend through the flange 90 and into the outer barrel 12 thereby securing the lower cap 86 to the outer barrel 12 (only two of the bolts 92 being shown in the drawing).

An opening 94 extends through a central portion of the lower cap 74, the lower end 26 portion of the inner barrel 22 being disposed through the opening 94 in the lower cap 94. A recess 96 is formed in the base 88 portion of the lower cap 86.

A portion of a lower seal assembly 98 is disposed in the recess 96 and the lower seal assembly 98 is adapted to sealingly engage the lower cap 86 and the outer peripheral surface of the inner barrel 22 or, more particularly, the lower sleeve 72, thereby cooperating to provide a fluid seal between the outer and the inner barrels 12 and 22. The lower seal assembly 98 forms a portion of the seal assembly 32.

It should be noted that, in a preferred embodiment, the upper and the lower sleeves 70 and 72 each are sized with respect to the upper and the lower seal assemblies 84 and 98 so that more surface area of the upper and the lower sleeves 70 and 72 is available for sealing engagement with the respective upper and lower seal assemblies 84 and 98 than indicated in the drawings. Initially, the upper and the lower seal assemblies 84 and 98 each are positioned in the respective recesses 83 and 96 so that the seal assemblies 84 and 98 engage respective portions of the sleeves 70 and 72 generally near the inner ends of the sleeves 70 and 72. In this manner, when the sleeve 70 and 72 wear as a result of the sealing engagement with the respective seal assemblies 84 and 98, the seal assemblies 84 and 98 can be pressed further into the respective recesses 83 and 96 to the positions shown in the drawing and, in this position, the seal assemblies 84 and 98 engage unworn portions of the respective sleeves 70 and 72. This reduces the costly replacement of the sleeves 70 and 72.

The rotating head 10 includes an upper bearing assembly 100 and a lower bearing assembly 102. The upper and the lower bearing assemblies 100 and 102 each engage a portion of the inner barrel 22 and a portion of the outer barrel 12, and the bearing assemblies 100 and 102 cooperate to rotatingly support the inner barrel 22 on the outer barrel 12 so the inner barrel 22 can rotate during the operation of the rotating head 10. The first and the second bearing assemblies 100 and 102 form a portion of the rotating support assembly 34.

The upper bearing assembly 100 includes a cone 104, a cup 106 and a plurality of rollers 108 (only two rollers 108 being shown in the drawing). The cone 104 has a plurality of openings and one of the rollers 108 is disposed in each of the openings in the cone 104. The cone 104 is disposed within the cup 106 and the rollers 108 rollingly or bearingly engage the cup 106. Tapered roller bearings such as generally described above with respect to the upper bearing assembly 100 are well known in the art and are commercially available from Timken Roller Bearing Company, for example.

As shown in the drawing, the upper end 24 portion of the inner barrel 22 extends through a central opening formed through the cone 104 of the upper bearing assembly 100 to a position wherein the cone 104 engages the support surface 62. In this position, the cup 106 portion of the upper bearing assembly 100 engages a portion of the upper cap 74 in a manner to be described in greater detail below.

The lower bearing assembly 102 is constructed exactly like the upper bearing assembly 100 in a preferred form and includes a cone 110, a cup 112 and a plurality of rollers 114 (only two rollers 114 being shown in the drawing). The cone 110 has a plurality of openings and one of the rollers 114 is disposed in each of the openings in the cone 110. The cone 110 is disposed within the cup 112 and the rollers 114 rollingly or bearingly engage the cup 112. Tapered roller bearings such as generally described above with respect to the lower bearing assembly 102 are well known in the art and are commercially available from Tinken Roller Bearing Company, for example.

As shown in the drawing, the lower end 26 portion of the inner barrel 22 extends through a central opening formed through the cone 110 of the lower bearing assembly 102 to a position wherein the cone 110 engages the support surface 64. In this position, the cup 112 portion of the lower bearing assembly 102 engages a portion of the lower cap 86.

The engagement of the inner and the outer barrels 22 and 12 with the upper and the bearing assemblies 100 and 102 secures the bearing assemblies 100 and 102 in position for rotatingly supporting the inner barrel 22 on the outer barrel 12. It is important that the cones 104 and 110 fit with the respective cups 106 and 108 in an aligned manner, or in other words, so that one is not cocked at an angle with respect to the other (referred to herein simply as being in bearing alignment). If the cones 104 and 110 are not in bearing alignment with the respective cups 106 and 108, increased friction or binding results thereby substantially reducing the ability of the inner barrel 22 to rotate during the operation of the rotating head 10.

The upper cap 74 portion of the outer barrel 12 includes a plurality of circumferentially spaced openings 116 extending therethrough intersecting the upper and the lower ends of the upper cap 74 (only two of the openings 116 being shown in the drawing. The openings 116 are aligned with the cup 106 portion of the upper bearing assembly 100, generally at a position near the outer peripheral surface of the cup 106.

The bearing adjustment assembly 76 includes a plurality of adjustment screws 118, each adjustment screw 118 threadedly extending through one of the openings 116 in the upper cap 74. Each of the adjustment screws 118 extends through one of the openings 116 to a position wherein one end of each of the adjustment screws 118 engages the cup 106. The bearing alignment of the upper bearing assembly 100 is adjustable by adjusting the engagement between the adjustment screws 118 and the cup 106. The bearing alignment accomplished on the upper bearing assembly 100 utilizing the adjustment screws 118 also has the effect of adjusting the bearing alignment of the lower bearing assembly 102.

In addition to the adjustment of bearing alingment accomplished via the adjustment screws 118, it also is important that, in an assembled position, the support surface 64 be substantially coplanar with the upper end of the lower cap 86 which engages the lower bearing assembly 102 since any deviation in this coplanar relationship would contribute to bearing misalignment in the lower bearing assembly 102 thereby reducing the ability of the inner barrel 22 to rotate during the operation of the rotating head 10. Further, in this regard, the support surface 62 should be substantially coplanar with the since any deviation in this coplanar relationship would tend to reduce the effect of the adjustment screws 118 to simultaneously adjust the bearing alignment of the lower bearing assembly 102 while directly affecting the upper bearing assembly 100.

It should be noted that the adjustment screws 118 are positioned so that access to such adjustment screws 118 is readily available in an assembled position of the rotating head 10 without the necessity of disassembling any portion of the rotating head 10. Thus, the bearing alignment of the upper and the lower bearing assemblies 100 and 102 can be readily adjusted in the field in an assembled position of the rotating head 10.

The lower end 26 of the inner barrel 22 is disposed in a plane spaced a distance generally below the planar disposition of the lower end 16 of the outer barrel 12. A generally circularly shaped adapter plate 120 is secured to the lower end 26 of the inner barrel 22 via a plurality of bolts 122 (only two of the bolts 122 being shown in the drawing). The adapter plate 120 has an opening 124 extending through a central portion thereof and, in an assembled position, the opening 124 in the adapter plate 120 is axially aligned with the inner barrel bore 28.

The rotary drive member 36 is connected to the adapter plate 120 by a plurality of circumferentially spaced bolts 126 (only two bolts 126 being shown in the drawing). The rotary drive member 36 includes an elastomeric member 128 and a reinforcing plate 130. The elastomeric member 128 has an upper end which forms the upper end 38 of the rotary drive member 36, a lower end which forms the lower end 40 of the rotary drive member 36 and an opening extending therethrough intersecting the upper and the lower ends 38 and 40, the opening throuugh the elastomeric member 128 being the drive bore 42 formed through the rotary drive member 36. The upper end 38 portion of the elastomeric member 128 is bonded or otherwise securedly attached to the plate 130 and the plate 130 is connected to the adapter plate 120 by the bolts 126, thereby connecting the elastomeric member 128 and the plate 130 (the rotary drive member 36) to the lower end 16 of the inner barrel 22 via the adapter plate 120 portion of the rotary drive member 36.

In an assembled position, the drive bore 42 through the rotary drive member 36 is axially aligned with the opening 124 in the adapter plate 120 and the inner barrel bore 28. The drive bore 42 through the rotary drive member 36, the opening 124 in the adapter plate 120 and the inner barrel bore 28 each are sized to receive the kelly 54 which extends through the axially aligned openings 42, 124 and 28 during the operation of the rotating head 10. More particularly, the opening 124 and the inner barrel bore 28 each have a diameter which is larger than the effective diameter of the kelly 54 so the kelly 54 can rotate freely within the opening 124 and the inner barrer bore 28 during the rotating head 10.

The drive bore 42 through the elastomeric member 128 preferrably has a generally circularly shaped cross section and the diameter of the drive bore 42 is less than the effective diameter of the kelly 54. Thus, the kelly 54 is forcibly inserted through the drive bore 42 in the elastomeric member 128 so the elastomeric member 128 grippingly and sealingly engages the portion of the kelly 54 extending through the drive bore 42.

It should be noted that the elastomeric member 128 could be constructed with a drive bore 42 having a non-circularly shaped cross section to mate with the non-circularly shaped cross section. However, it has been found that such non-circularly shaped openings in the elastomeric member 128 then must be aligned with the kelly 54 to effect a secure gripping and sealing between the elastomeric member 128 and the kelly 54 and, if not aligned, the gripping and sealing between the elastomeric member 128 and the kelly 54 is not as effective. The circularly shaped drive bore 42 provides an elastomeric shape which effectively grips and seals with the kelly 54 regardless of the rotational alignment of the kelly 54 with respect to the drive bore 42.

A clamp flange 138 is formed on the outer peripheral surface of the outer barrel 12 and the clamp flange 138 extends a distance radially from the outer peripheral surface of the outer barrel 12, thereby providing an upwardly facing clamp surface 140 and a downwardly facing surface 142. A recess 144 is formed in the clamp surface 140 and the recess 144 extends circumferentially about the clamp surface 140. The clamp flange 138 is disposed generally between the upper and the lower ends 14 and 16 of the outer barrel 12.

In an assembled position, the lower end 16 portion of the outer barrel 12 extends a distance into the bowl opening 50 generally near the upper end 46 of the bowl 44, to a position wherein the upper end 46 of the bowl 44 engages the downwardly facing surface 142. A groove 148 is formed in the upper end 46 of the bowl 44. A ring member 150 is formed on the downwardly facing surface 142 of the outer barrel 12, the ring member 150 extending a distance from the downwardly facing surface 142 and being alignable with the groove 148 in the upper end 46 of the bowl 44. The ring member 150 is disposed in the groove 148 and sealingly engages the upper end 46 of the barrel 44 in the assembled position, thereby forming a fluid seal between the bowl 44 and the outer barrel 12. The ring member 150 and the upper end 46 of the bowl 44 each are of a metal construction and, thus, there is a metal-to-metal seal between the bowl 44 and the outer barrel 12 in the assembled position.

The rotating head 10 includes a plurality of clamps 152 and each clamp 152 is connected to the upper end 46 portion of the bowl 44 and is removably connectable to a portion of the outer bowl 44 for removably connecting the bowl 44 to the outer barrel 12 (only two of the clamps 152 being shown in the drawing). The clamps 152 are identical in construction and each clamp 152 includes: a rod 154 having one end pivotally connected to the outer peripheral surface of the outer barrel 12, a bar 156 which is threadedly connected to the end of the rod 154, opposite the end of the rod 154 which is pivotally connected to the outer barrel 12 and a nut 158 which is threadedly connected to the rod 154 and which is engageable with the bar 156 (the rod 154, the bar 156 and the nut 158 being designated by reference numerals in the drawing only with respect to one of the clamps 152). When the outer barrel 12 has been positioned in the bowl opening 50 with the downwardly facing surface 142 of the clamp flange 138 engaging the upper end 46 of the bowl 44 (the ring member 150 being disposed therebetween), the rods 154 are pivoted in an upward direction to a position wherein the bars 156 extend generally over the clamp surface 140, a lip 160 on each bar 156 engaging the clamp surface 140 and extending into the recess 144. In this position, the nuts 158 are tightened down to secure the bars 156 in clamping engagement with the clamp flange 138, the clamps 152 also providing a means for tightening the engagement between the outer barrel 12 and the upper end 14 of the outer barrel 12 with the ring member 150 disposed therebetween thereby tighteningly securing the fluid seal between the outer barrel 12 and the bowl 44 provided by the ring member 150.

A discharge pipe 162 is connected to the outer peripheral surface of the bowl 44. The discharge pipe 162 has an opening extending therethrough and the opening in the discharge pipe 162 is aligned with the discharge opening 52 in the bowl 44.

As shown in the drawing, the rotating head 10 also includes a lid 164. The lid 164 includes a lid base 165 which has a lid opening 166 extending therethrough intersecting the upper and the lower ends 167 and 168 of the lid base 165. A portion of the inner peripheral surface formed via the lid opening 166 is threaded and adapted to threadedly engage the threaded portion of the outer peripheral surface of the adapter plate 120, thereby threadedly connecting the lid 164 to the adapter plate 120. A lid flange 169 is formed on the lower end 168 of the lid base 165 and the lid flange 169 extends a distance radially inwardly into the lid opening 166.

In the connected position, the lid flange 169 extends a distance radially inwardly to a position wherein the outer most end of the lid flange 169 is near, but does not abut the outer peripheral surface of the elastomeric member 128 (spaced a distance from the outer peripheral surface of the elastomeric member 128) and the lid flange 168 circumferentially encompasses a space 170, one end of each of the bolts 126 being disposed within the space 170. Further, in a connected position of the lid 164, the lid flange 168 preferrably abuts one end of each of the bolts 126, as shown in the drawing.

In a preferred embodiment, a plurality of set screws are threaded through the lid base 165, generally near the upper end 167, and into the adapter plate 120 for preventing rotation of the lid 164 which may result in unthreading the lid 164 from the adapter plate 120. Also, in a preferred form, the threads on the lid 164 and the mating threads on the adapter plate 120 each are formed of two spaced apart threaded portions with an unthreaded portion positioned generally between the two spaced apart threaded portions, the set screws extending through the unthreaded portions of the lid 164 and adapter plate 120 to prevent damage to the threads by the set screws.

Also, a portion of the outer peripheral surface generally near the connection of the lid flange 169 to the lid base 165 may be formed on a bevel, a preferred form of construction.

The space 172 between the inner barrel 22 and the outer barrel 12 (the space between the inner peripheral wall formed by the outer barrel bore 18 and the outer peripheral surface of the inner barrel 22 and between the upper and the lower caps 74 and 86) is packed with grease to provide the necessary lubrication for the upper and the lower bearing assemblies 100 and 102. The rotating head 10 requires no external lubricating system.

During the operation, the kelly 54 extends through the inner barrel bore 28, the opening 124 in the adapter plate 120, the drive bore 42 in the elastomeric member 128 and through the bowl opening 50. Since the diameter of the drive bore 42 in the elastomeric member 128 is smaller than the effective diameter of the kelly 54, a portion of the drive bore 42, generally near the upper end 38, is tapered to guide the kelly 54 into the drive bore 42 and the kelly 54 is forced through the drive bore 42. The elastomeric member 136 grips and sealingly engages the kelly 54. The kelly 54 rotates and, due to the gripping engagement between the kelly 54 and the elastomeric member 128, the rotation of the kelly 54 causes the rotary drive member 36 to rotate following the rotation of the kelly 54. Since the rotary drive member 36 is connected to the inner barrel 22, the rotation of the rotary drive member 34 cause the inner barrel 22 to rotate, the inner barrel 22 being rotatingly supported on the outer barrel 12 via the rotating support assembly 34. The rotation of the inner barrel 22 and the rotary drive member 36 facilitates the maintaining of the sealing engagement between the kelly 54 and the elastomeric member 128 in a manner which substantially reduces the wearing of the elastomeric member 128. It is significant to note that the rotary drive member 36 provides the only means for rotating the inner barrel 22 and the rotating head 10 does not utilize any additional or other drive source for rotating the inner barrel 22 and the elastomeric member 128 connected thereto.

Drilling fluid enters the open lower end 48 of the bowl 44 in the direction 56 and the drilling fluid enters into the bowl opening 50, the bowl opening 50 forming and sometimes being referred to herein as a chamber. The sealing engagement between the elastomeric member 128 and the kelly 54 substantially prevents the drilling fluid from passing upwardly through the drive bore 42 in the elastomeric member 128 and through the inner barrel bore 28. The lower seal assembly 98 sealingly engages the outer peripheral surface of the inner barrel 22 and the outer barrel 12, thereby substantially preventing the drilling fluid from passing into and through the outer barrel bore 18 or, more particularly, through the space between the inner barrel 22 and the outer barrel 12. The sealing engagement between the outer barrel 12 and the bowl 44 provided by the sealing engagement of the ring member 150 substantially prevents the drilling fluid from passing through the connection between the outer barrel 12 and the bowl 44. Thus, the chamber or bowl opening 50 is sealed so the drilling fluid which enters through the open lower end 48 of the bowl 44 is diverted and passed in a direction 58 through the discharge opening 52 and through the discharge pipe 162 for passing such drilling fluid back to the mud pit, for example.

In a preferred form, the upper and the lower seal assemblies 84 and 98 are of the type commonly referred to in the art as Garlock seals, and such seals are commerically available.

In a preferred form, the elastomeric member 128 and the plate 130 connected thereto are of the type well known in the art and commercially available from such souurces as Grant Oil Tool, for example.

It should be noted that, in one operable embodiment of the rotating head 10 has an opening (not shown in the drawings) which is formed through the outer barrel 12 in communication with the space between the inner and outer barrels 22 and 12 and between the upper and the lower bearing assemblies 100 and 102 for injecting grease into this space. The injected grease flows through and about the upper seal assembly 84 and, since the upper seal assembly is positioned to seal only in one direction, the excess grease is permitted to pass the upper seal assembly 84 when enough grease has been injected.

Finally, it should be noted that the bowl 44 could be of a larger diameter construction with an upper flange adapted to accept an outer barrel 12 of a relatively much smaller diameter construction by supporting the clamps 152 on angle plates which are hinged to the bowl 44 and moveable to a position wherein the clamp 152 can clampingly engage the outer barrel 12. In this manner, the same smaller diameter bearing assemblies (outer barrel 12 with the inner barrel 22 and the bearing assemblies 100 and 102 assembled thereon) which permits the bearing assemblies to be assembled and lowered through the rotary table. This construction is useful when the size of the rotating head 10 or, more particularly, the bearing assemblies exceeds the size of the opening through the rotary table.

Changes may be made in the various elements and assemblies disclosed herein and the steps or the sequence of steps of the methods disclosed herein without departing from the spirit and the scope of the invention as defined in the claims.

What is claimed is:

1. A rotating head adapted for use in drilling a well borehole at a well drilling site wherein drilling fluid is passed into the well borehole and wherein some of the drilling fluid is passed from the well borehole and wherein a rotatable kelly, having a non-circular cross section, extends into the well borehole during the drilling operations, comprising:

an outer barrel having an upper end, lower end and an outer barrel bore extending therethrough and intersecting the upper and lower ends thereof;

an inner barrel having an upper end, lower end and an inner barrel bore extending therethrough and intersecting the upper and lower ends thereof, at least a portion of the inner barrel being disposed in the outer barrel bore and a portion of the kelly being extendable through the inner barrel bore during the drilling operations;

means for providing a fluid seal between the inner and outer barrels;

means for rotatingly supporting the inner barrel on the outer barrel; and a rotary drive member connected to the lower end portion of the inner barrel and having a drive bore extending through a portion thereof, the drive bore having a circular shaped cross section, a portion of the kelly being extendable through the drive bore in the rotary drive member during the drilling operations and the rotary drive member grippingly and sealingly engaging the portion of the kelly extending therethrough, the rotation of the kelly causing the rotary drive member to rotate due to the gripping engagement therebetween and causing the rotation of the inner barrel due to the connection of the inner barrel and the rotary drive member, the gripping engagement between the rotary drive member and the kelly providing the sole means for rotating the inner barrel and the rotary drive member connected thereto.

2. The rotating head of claim 1 defined further to include:

a bowl having an upper end, a lower end, a bowl opening extending therethrough intersecting the upper and the lower ends thereof and a discharge opening formed through a portion thereof, the upper end portion of the bowl being connected to the outer barrel, and the lower end portion of the inner barrel and the rotary drive member being disposed within the bowl opening, and drilling fluid being passable into the bowl opening via the open lower end of the bowl and the drilling fluid being passed from the bowl opening through the discharge opening in the bowl, and the sealing engagement between the rotary drive member and the kelly substantially preventing the drilling fluid in the bowl opening from passing through the drive bore in the rotary drive member.

3. The rotating head of claim 2 wherein the outer barrel is defined further to include:

a clamp flange formed on the outer peripheral surface of the outer barrel and extending radially from the outer barrel and extending circumferentially about the outer barrel, the clamp flange providing an upwardly facing clamp surface extending circumferentially about the outer barrel and a downwardly facing surface extending circumferentially about the outer barrel; and wherein the rotating head is defined further to include:

a plurality of clamps, each clamp including:

a rod having one end pivotally connected to the bowl;

a bar connected to the end of the rod, opposite the end of the rod pivotally connected to the bowl, the bar extending from the rod and being engageable with the clamp surface of the clamp flange; and means for securing the bar in engagement with the clamp surface of the clamp flange.

4. The rotating head of claim 1 wherein the means for rotatingly supporting the inner barrel on the outer barrel is defined further to include:

an upper bearing assembly disposed between the outer peripheral surface of the inner barrel and the inner peripheral surface of the outer barrel formed by the outer barrel bore, a portion of the upper bearing assembly engaging the inner barrel and another portion of the upper bearing assembly engaging the outer barrel, the upper bearing assembly cooperating to bearingly support the inner barrel on the outer barrel and the upper bearing assembly being disposed generally near the upper end of the outer barrel.

5. The rotating head of claim 4 wherein the outer barrel is defined further to include:

an upper cap connected to the upper end portion of the outer barrel and extending circumferentially about the outer barrel, the upper cap extending a distance into the outer barrel bore to a position wherein a portion of the upper cap is disposed generally above a portion of the upper bearing assembly and the upper cap having an opening extending through a central portion thereof through which the kelly is passable during the drilling operations; and a plurality of adjustment screws, each adjustment screw extending through the upper cap to a position wherein one end of each of the adjusting screws engages a portion of the upper bearing assembly for adjusting the bearing alignment of the upper bearing assembly.

6. The rotating head of claim 5 wherein the means for rotatingly supporting the inner barrel on the outer barrel is defined further to include:

a lower bearing assembly disposed near the lower end of the outer barrel and disposed between the outer peripheral surface of the inner barrel and the inner peripheral surface of the outer barrel formed by the outer barrel bore, a portion of the lower bearing assembly engaging the inner barrel and another portion of the lower bearing assembly engaging the outer barrel, the lower bearing assembly cooperating to bearingly support the inner barrel on the outer barrel.

7. The rotating head of claim 6 wherein the upper and the lower bearing assemblies each are defined further to include:

a cup;

a cone disposed in a portion of the cup; and a plurality of rollers supported on the cone and bearingly engaging the cup.

8. The rotating head of claim 6 wherein the outer barrel is defined further to include:

a lower cap connected to the lower end portion of the outer barrel and extending circumferentially about the outer barrel, the lower cap extending a distance into the outer barrel bore to a position wherein a portion of the lower cap engages a portion of the lower bearing assembly, the lower cap having an opening extending through a central portion thereof through which the kelly is passable during the drilling operations.

9. The rotating head of claim 8 wherein the inner barrel is defined further to include:

a support flange formed on the outer peripheral surface of the inner barrel generally between the upper and the lower ends of the inner barrel, the support flange extending a distance radially from the inner barrel and providing an upwardly facing support surface extending circumferentially about the inner barrel and engageable with a portion of the upper bearing assembly and a downwardly facing support surface extending circumferentially about the inner barrel and engageable with a portion of the lower bearing assembly.

10. The rotating head of claim 1 wherein the rotary drive member is defined further to include:

an elastomeric member having an upper end and a lower end, the drive bore through the rotary drive member being formed through the elastomeric member and such drive bore extending through the elastomeric member and intersecting the upper and the lower ends thereof, the upper end of the elastomeric member being connected to the lower end of the inner barrel.

11. The rotating head of claim 10 defined further to include:

an adapter plate having an opening extending through a central portion thereof through which the kelly is extendable during the drilling operations, the adapter being connected to the lower end of the inner barrel with the opening in the adapter being generally aligned with the inner barrel bore, the upper end of the elastomeric member being connected to the adapter with the drive bore through the elastomeric member being aligned with the opening in the adapter and the inner barrel bore.

12. The rotating head of claim 1 wherein the outer barrel is defined further as being cylindrically shaped, and wherein the inner barrel is defined further as being cylinderically shaped, the inner barrel being disposed in the outer barrel bore to a position wherein the upper end of the inner barrel is about coplanar with the upper end of the outer barrel and the lower end of the inner barrel is about coplanar with the lower end of the outer barrel.

13. A rotating head adapted for use in drilling a well borehole at a well drilling site wherein drilling fluid is passed into the well borehole and wherein some of the drilling fluid is passed from the well borehole and wherein a rotatable kelly extends into the well borehole during the drilling operations comprising:

an outer barrel having an upper end, a lower end and an outer barrel bore extending therethrough and intersecting the upper and the lower ends thereof;

an inner barrel having an upper end, a lower end and an inner barrel bore extending therethrough and intersecting the upper and lower ends thereof, at least a portion of the inner barrel being disposed in the outer barrel bore and a portion of the kelly being extendable through the inner barrel bore during the drilling operations;

means for providing a fluid seal between the inner and the outer barrel;

rotary drive member connected to the lower end of the inner barrel and having a drive bore extending through a portion thereof, a portion of the kelly being extendable through the drive bore in the rotating drive member during the drilling operations and the rotary drive member sealingly engaging the poriton of the kelly extending therethrough;

an upper bearing assembly disposed between the outer peripheral surface of the inner barrel and the inner peripheral surface of the outer barrel formed by the outer barrel bore, a portion of the upper bearing assembly engaging the inner barrel and another portion of the upper bearing assembly engaging the outer barrel, the upper bearing assembly cooperating to bearingly support the inner barrel on the outer barrel and the upper bearing assembly being disposed generally near the upper end of the outer barrel;

a lower bearing assembly disposed near the lower end of the outer barrel and disposed between the outer peripheral surface of the inner barrel and the inner peripheral surface of the outer barrel formed by the outer barrel bore, a portion of the lower another portion of the lower bearing assembly engaging the outer barrel, the lower bearing assembly being spaced a distance from the upper bearing assembly and cooperating with the upper bearing assembly to bearingly support the inner barrel on the outer barrel;

an upper cap connected to the upper end portion of the outer barrel and extending circumferentially about the outer barrel, the upper cap extending a distance into the outer barrel bore to a position wherein a portion of the upper cap is disposed generally above a portion of the upper bearing assembly and the upper cap having an opening extending through a central portion thereof through which the kelly is passable during the drilling operations; and a plurality of adjustment screws, each adjustment screw extending through the upper cap to a position wherein one end of each of the adjusting screws engages a portion of the upper bearing assembly for adjusting the bearing alignment of the upper bearing assembly from a position external of the rotating head and without removing the upper cap.

14. The rotating head of claim 13 wherein the upper and the lower bearing assemblies are defined further to include:

a cup;

a cone disposed in a portion of the cup; and a plurality of rollers supported on the cone and bearingly engaging the cup.

15. The rotating head of claim 13 wherein the outer barrel is defined further to include:

a lower cap connected to the lower end portion of the outer barrel and extending circumferentially about the outer barrel, the lower cap extending a distance into the outer barrel bore to a position wherein a portion of the lower cap engages a portion of the lower bearing assembly, the lower cap having an opening extending through a central portion thereof through which the kelly is passable during the drilling operations.

16. The rotating head of claim 15 wherein the inner barrel is defined further to include:

a support flange formed on the outer peripheral surface of the inner barrel generally between the upper and the lower ends of the inner barrel, the support flange extending a distance radially from the inner barrel and providing an upwardly facing support surface extending circumferentially about the inner barrel and engageable with a portion of the upper bearing assembly and a downwardly facing support surface extending circumferentially about the inner barrel and engageable with a portion of the lower bearing assembly.

17. The rotating head of claim 13 defined further to include:

a bowl having an upper end, a lower end, a bowl opening extending therethrough intersecting the upper and the lower ends thereof and a discharge opening formed through a portion thereof, the upper end portion of the bowl being connected to the outer barrel, and the lower end portion of the inner barrel and the rotary drive member being disposed within the bowl opening, and drilling fluid being passable into the bowl opening via the open lower end of the bowl and the driling fluid being passed from the bowl opening through the discharge opening in the bowl, and the sealing engagement between the rotary drive member and the kelly substantially preventing the drilling fluid in the bowl opening from passing through the drive bore in the rotary drive member.

18. The rotating head of claim 17 wherein the outer barrel is defined further to include:

a clamp flange formed on the outer peripheral surface of the outer barrel and extending radially from the outer barrel and extending circumferentially about the outer barrel, the clamp flange providing an upwardly facing clamp surface extending circumferentially about the outer barrel and a downwardly facing surface extending circumferentially about the outer barrel; and wherein the rotating head is defined further to include:

a plurality of clamps, each clamp including:

a rod having one end pivotally connected to the bowl;

a bar connected to the end of the rod, opposite the end of the rod pivotally connected to the bowl, the bar extending from the rod and being engageable with the clamp surface of the clamp flange; and means for securing the bar in engagement with the clamp surface of the clamp flange.

* * * * *